US007744401B2

(12) United States Patent
DeSaint et al.

(10) Patent No.: US 7,744,401 B2
(45) Date of Patent: Jun. 29, 2010

(54) DEVICE FOR CONNECTING A CONNECTOR TO A SOLENOID DRIVING AN INJECTOR

(75) Inventors: Gérard DeSaint, Carqueiranne (FR); Jean-Louis Magnaval, Saint Laurent du Var (FR); Pascal Audineau, Ventimiglia (IT)

(73) Assignee: BorgWarner, Inc., Auburn Hills, MI (US)

( * ) Notice: Subject to any disclaimer, the term of this patent is extended or adjusted under 35 U.S.C. 154(b) by 52 days.

(21) Appl. No.: 11/992,040

(22) PCT Filed: Sep. 14, 2006

(86) PCT No.: PCT/FR2006/002108

§ 371 (c)(1),
(2), (4) Date: Mar. 14, 2008

(87) PCT Pub. No.: WO2007/031652

PCT Pub. Date: Mar. 22, 2007

(65) Prior Publication Data

US 2009/0156063 A1 Jun. 18, 2009

(30) Foreign Application Priority Data

Sep. 15, 2005 (FR) ..... 05 09433

(51) Int. Cl.
*H01R 4/24* (2006.01)

(52) U.S. Cl. ..... 439/387; 439/34; 439/130

(58) Field of Classification Search ..... 439/34, 439/130, 387, 388, 688
See application file for complete search history.

(56) References Cited

U.S. PATENT DOCUMENTS

| | | | | |
|---|---|---|---|---|
| 4,502,632 | A | 3/1985 | Hafner et al. | |
| 5,203,304 | A | 4/1993 | Hafner et al. | |
| 6,299,079 | B1 | 10/2001 | Noller et al. | |
| 6,564,775 | B1 | 5/2003 | Kikuta et al. | |
| 6,688,578 | B1 | 2/2004 | Nussio et al. | |
| 6,848,919 | B2 * | 2/2005 | Stitz et al. | 439/130 |
| 7,182,603 | B1 * | 2/2007 | Koneda et al. | 439/34 |

FOREIGN PATENT DOCUMENTS

JP 1249960 10/1989

* cited by examiner

*Primary Examiner*—Khiem Nguyen
(74) *Attorney, Agent, or Firm*—Warn Partners, P.C.

(57) ABSTRACT

The invention concerns a device for connecting a mechanical, hydraulic and electric connector (1) equipping a heat engine fuel injector to the electromagnet driving the injector, said connector (1) being fixed to a body (2) enclosing the electromagnet and comprising two electric terminals (4) connected to the solenoid (S) of the electromagnet. Said electric terminals (4) are provided each with a pin (15) designed so that when the connector (1) is assembled to the body (2), each pin (15) co-operates with guide means (11, 14) contacting an end portion of the wire (12) of the solenoid (6), the assembling operation resulting in pulling off the insulation in at least one location of said end portion to set up an electrical connection between each terminal (4) and the solenoid (6).

14 Claims, 5 Drawing Sheets

DEVICE FOR CONNECTING A CONNECTOR TO A SOLENOID DRIVING AN INJECTOR

This application is a National Stage of International Application No. PCT/FR2006/002108, filed Sep. 14, 2006. This application claims priority to French Patent Application No. FR0509433 filed on Sep. 15, 2005. The disclosures of the above applications are incorporated herein by reference.

The present invention relates to a connection device for connecting a mechanical, hydraulic and electrical connector with which a combustion engine fuel injector is equipped, to the electromagnet of the injector. This connector is in fact designed to be fixed to the body surrounding said electromagnet.

The triple function of the connector means that it has to be fixed to said body in a way which meets the requirements and suits the features associated with each of the functions and allows them to coexist. Thus, the upper part of the injector that assembling them constitutes must allow a hydraulic return of the injector control fluid. The mechanical connection must therefore guarantee that the internal hydraulic chamber created by said assembly for this purpose is sealed. This connection must in addition establish an electrical connection between, on the one hand, the terminals that connect the connector to an electronic control unit and, on the other hand, the solenoid of the electromagnet that drives the injector.

In order to make this electrical connection, in present-day injectors, rigid pins with which the ends of the wire of the solenoid and said connector terminals are equipped are soldered together. These pins protrude from the field frame of the coil in the direction of the terminals of the connector, the internal ends of which are themselves directed toward the pins. The soldering operation does, however, greatly complicate the assembling of the upper part of the injector, and obviously has an unfavorable impact on the economics.

It is an object of the present invention to produce a device for connecting the connector to the body of the electromagnet that automatically makes the electrical connection between the connector and the solenoid while they are being mechanically connected.

To do this, the two electric terminals are each equipped with a pin designed such that, while the connector is being assembled with the body, each pin collaborates with guide means in contact with an end portion of the wire of the solenoid, the assembly operation leading to the insulation being stripped away from at least one spot of said end portion with a view to establishing an electrical connection between each terminal and the solenoid.

In other words, the configuration is designed such that, during assembly, the respective paths of each pin and of the end portions of the wire interfere with one another. Their relative positioning has therefore to be fairly precise, because the interaction needs to be controlled in such a way that only the insulation is removed in order to bring the terminal and the wire into contact. The mechanical configuration of the various components needs in fact to bring the pins and the ends of the solenoid together and then guide them as they move toward one another.

Removing the insulation during the crimping operation is a decisive advantage of the invention, particularly in terms of industrial process, because it eliminates the need to make the electrical connection beforehand, and makes it possible, in contrast, for the electrical and mechanical connections to be made simultaneously.

According to the invention, the field frame in which the solenoid of the electromagnet is wound comprises two protrusions acting as supports for the ends of the wire and directed along the axis of assembly.

Each support additionally comprises guide means for guiding the pin into contact with at least one end portion of the wire of the solenoid.

In order to be able to meet the objective of removing insulation at certain spots on the wire, it is necessary, on the one hand, for the supports to be rigid enough that they prevent the portions of wire involved from being brushed aside and, on the other hand, for guidance to be accurate enough that the contact force created is sufficient to strip the insulation away.

According to one possible configuration, each pin is in the form of a fork with two prongs of parallel appearance directed along the axis of assembly. These prongs, made of conducting metal, allow an elastic excursion which improves the mechanical viability of the system (particularly by helping them to enter the guide system). More specifically, each prong may, for example, adopt the shape of half an arrowhead the cross section of which decreases toward its free end, the prongs of the fork preferably being symmetric with respect to a median longitudinal axis.

For its part, the support comprises a central post near the free end of which the wire of the solenoid is wound, in several contiguous turns.

The use of several contiguous turns makes it possible to guarantee that the electrical connection will be made by multiplying the potential points of contact with the terminal belonging to the connector. The use of a two-pronged pin further doubles the number of possible contact points. The two prongs of the fork are designed to plug in one on each side of the central post.

According to one possible configuration, the central post is then flanked by two lateral flanges in which a slot is formed to guide the prongs of the fork. It should be noted that the free end of the post may be cleft.

The guide slots house the prongs in such a way that they remain in contact, with a not insignificant amount of friction that will allow the insulation to be removed, with the turns of the wire as they slide along said slots.

According to the invention, each support and each pin are preferably directed parallel to the axis of the solenoid. Thus, the opposing paths of the supports and of the terminals are, in this instance, parallel to the overall axis of the injector.

The solenoid is wound in a field frame positioned coaxially with respect to the body of the injector. According to the invention, the support-forming protrusions extend from the field frame and can be manufactured as one with this field frame.

The need for accurate relative angular positioning of, on the one hand, the supports and, on the other hand, the terminals, was mentioned earlier. Thus, according to the invention, the connector and the body surrounding the electromagnet are provided with a polarizing system to allow the one to be correctly angularly positioned and immobilized with respect to the other so that, during assembly, each pin can be brought into register with a support and the wire which is fixed thereto.

As a preference, said polarizing system consists in a projection extending beyond the connector, directed parallel to the axis of assembly and designed to collaborate with a cutout made in a pole piece of the electromagnet surrounding the solenoid.

The invention will now be described in greater detail with reference to the attached figures in which.

Figure 1:
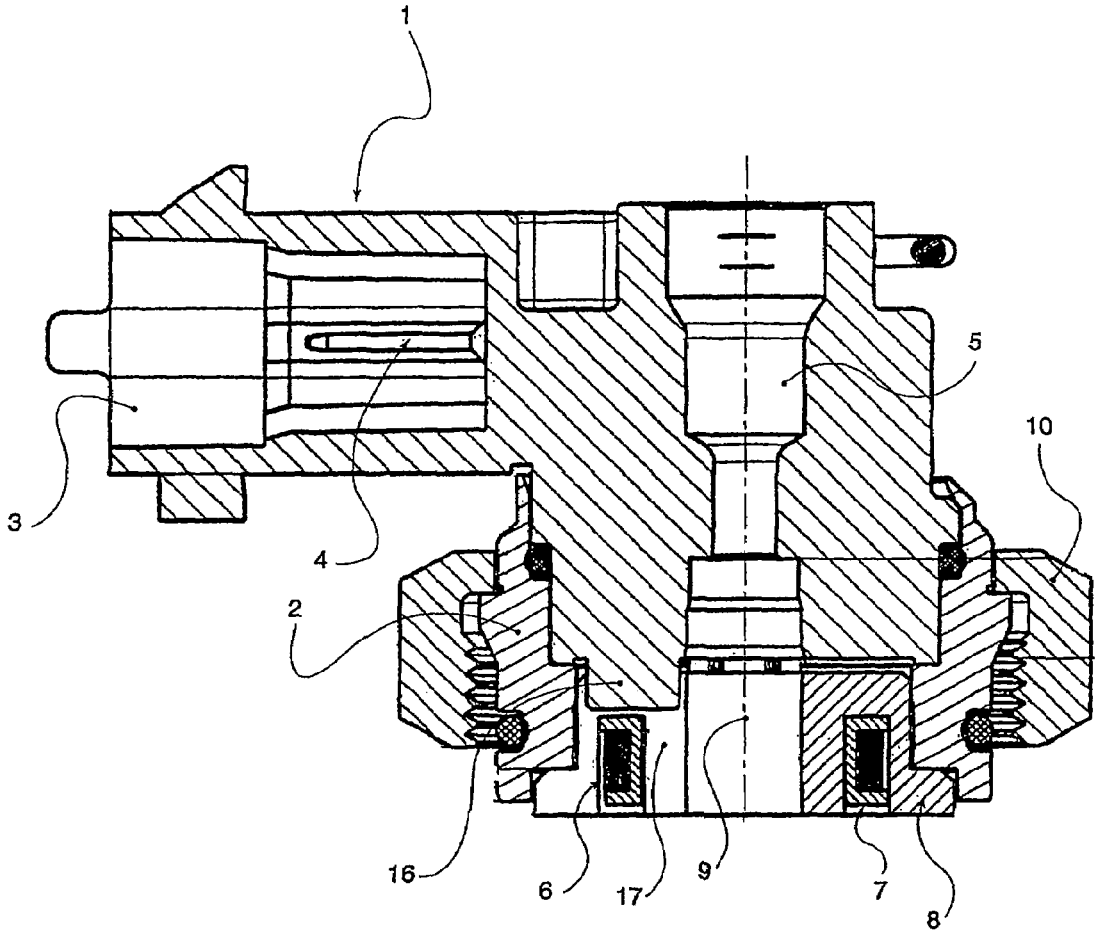
FIGS. 1 and 2 show sectioned views of the entity formed by the connector and the body of the electromagnet.

With reference to FIG. 1, the connector (1) of the injector is fixed to the body (2) of the electromagnet, their assembly constituting the upper part of the injector. The connector (1) has an electrical connection outlet (3) allowing the injector to be connected to a control unit that electronically controls the injector. The connector (1) comprises terminals (4) designed to collaborate with an external connector (not depicted) positioned at the end of a control bus emanating from said unit. The return of the excess fuel in the injector is accomplished via a chamber (9) and the duct (5) forming a hydraulic sink. The body (2) also surrounds a solenoid (6) wound around a field frame (7) and surrounded by a pole piece (8) made of cast steel, these elements constituting the electromagnet of the injector. The solenoid (6) is coaxial with the hydraulic sink (5). The hydraulic chamber (9) in particular allows for assembly of the injector control valve (not depicted) while this injector is being fitted. A nut (10) surrounds the body (2) to fasten the connector/electromagnets assembly to the remainder of the injector.

Figure 2:
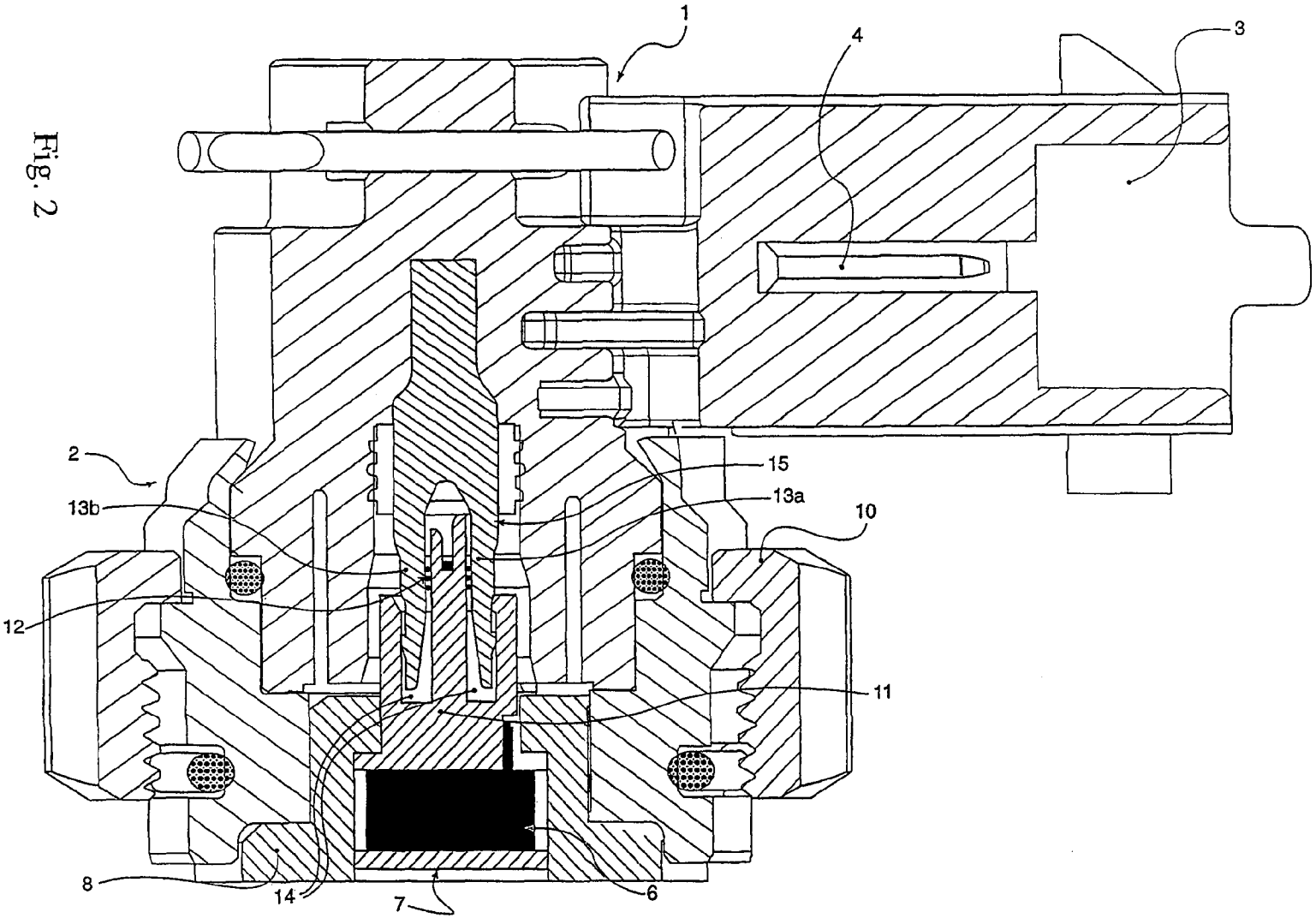
Figure 3:
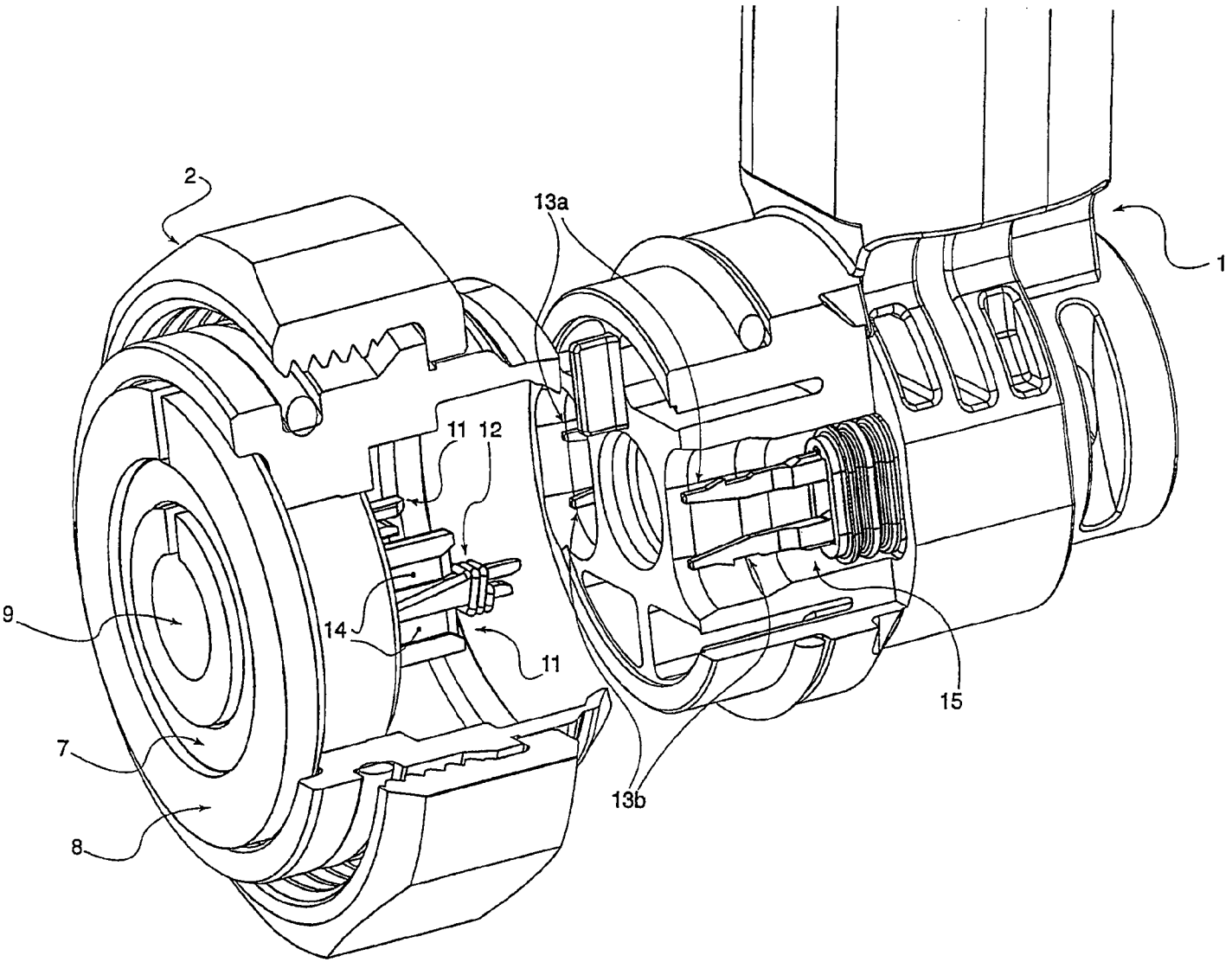
FIGS. 3 and 4 are perspective views of these two elements during assembly, showing two distinct phases in the making of the electrical connection.

The view in FIG. 1 in fact shows the main components of the upper part of an injector, without going into details regarding the electrical connection which form the essential subject matter of the present invention. These details are revealed more specifically in the subsequent figures. Thus, in FIG. 2, the section is taken in the region of an electrical connection and, in FIG. 3, a deliberately truncated part of the perspective reveals, around the edges of the interior cavities (5, 9), on the one hand, a support (11) around which the end of the wire (12) of the solenoid (6) is wound and, on the other hand, prongs (13*a*, 13*b*) secured to the connector (1) and electrically connected to the terminals (4) constituting a forked pin (15) (the connection fork (15) is, in this particular instance, made as one with the terminal (4)).

Figure 4:
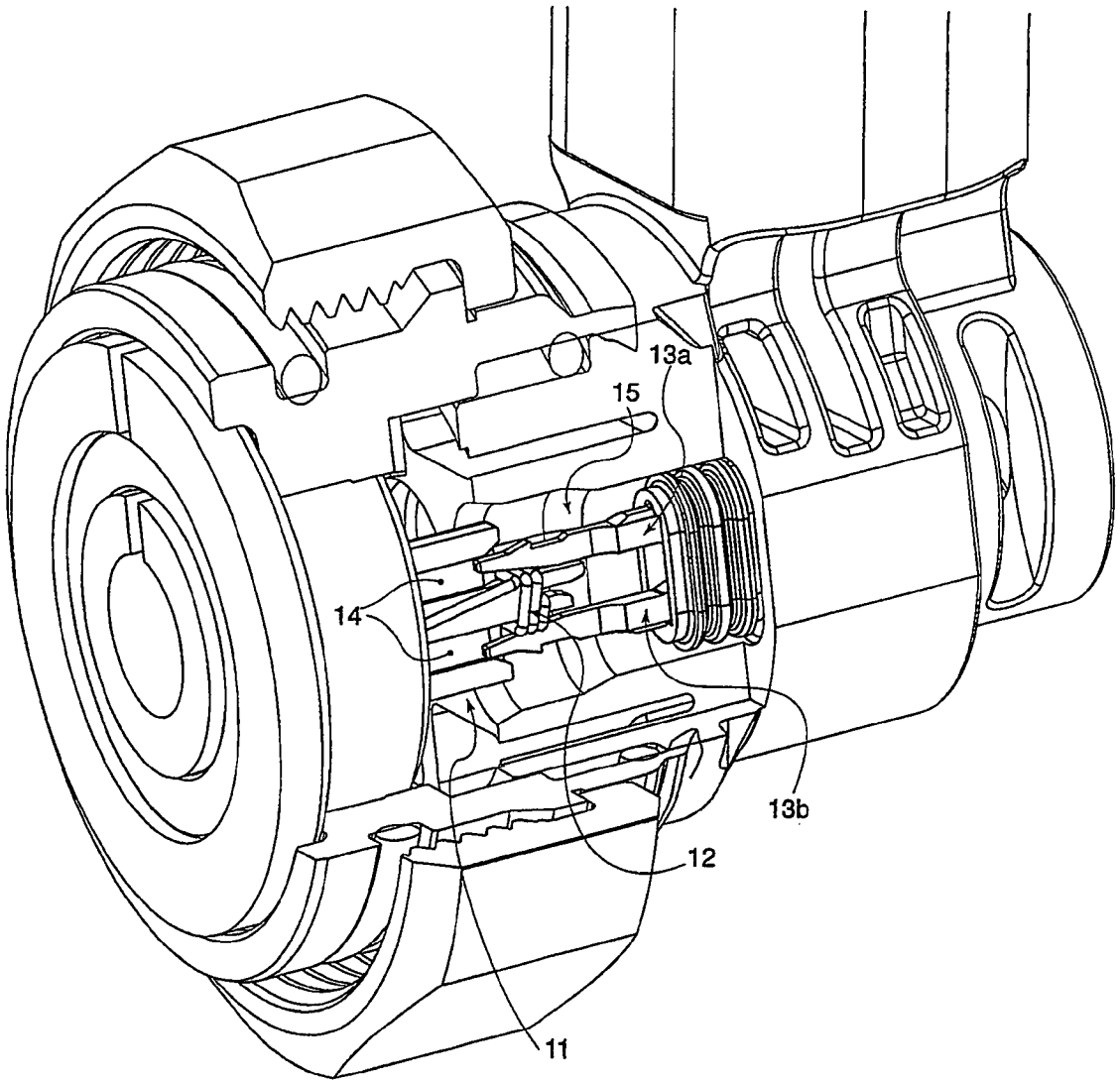

The same support (11)/prongs (13*a*, 13*b*) pairing exists and can be seen (see FIG. 3) in a diametrically opposed location on the periphery of the assembly. These elements are positioned more or less along the same axis, being in fact parallel to the axis of assembly, and are designed to come together during the plugging-together operation via which assembly is performed. This is what is shown in FIG. 4 which depicts an intermediate step preceding the end of assembly. In this step, the prongs (13*a*, 13*b*) of the fork (15) are already in contact with the turns of the wire (12) and with the support (11). The latter has lateral slots (14) capable partially of housing and therefore of guiding the prongs (13*a*, 13*b*) of the pin (15). These at their ends have the shape of a half arrowhead which contributes to the electromechanical connection function by making it easier to introduce the prongs (13*a*, 13*b*) into the slots (14). The respective widths of the slots (14) and of the prongs (13*a*, 13*b*) allow said prongs (13*a*, 13*b*) to be clamped into contact with the turns (12) in such a way that there is enough friction to strip away the insulation.

The elasticity allowed as a result of the shape and material of the fork (15) and of its two prongs (13*a*, 13*b*) comes into its own in this step in particular. In order to prevent the wires from purely and simply being dislodged by poorly sized prongs (13*a* and 13*b*) arriving from the opposite direction, it is necessary to build in wide dimensional tolerances, these possibly being compensated for during connection because the elements interacting with one another are capable of deforming slightly.

During insertion, the prongs (13*a* and 13*b*) are gradually brought toward the turns of the wire (12) because the lateral tip of each half arrowhead comes into contact with the external edging of the slot (14). Friction increases and becomes sufficient to strip away the insulation. Electrical connection can be made.

Figure 5:
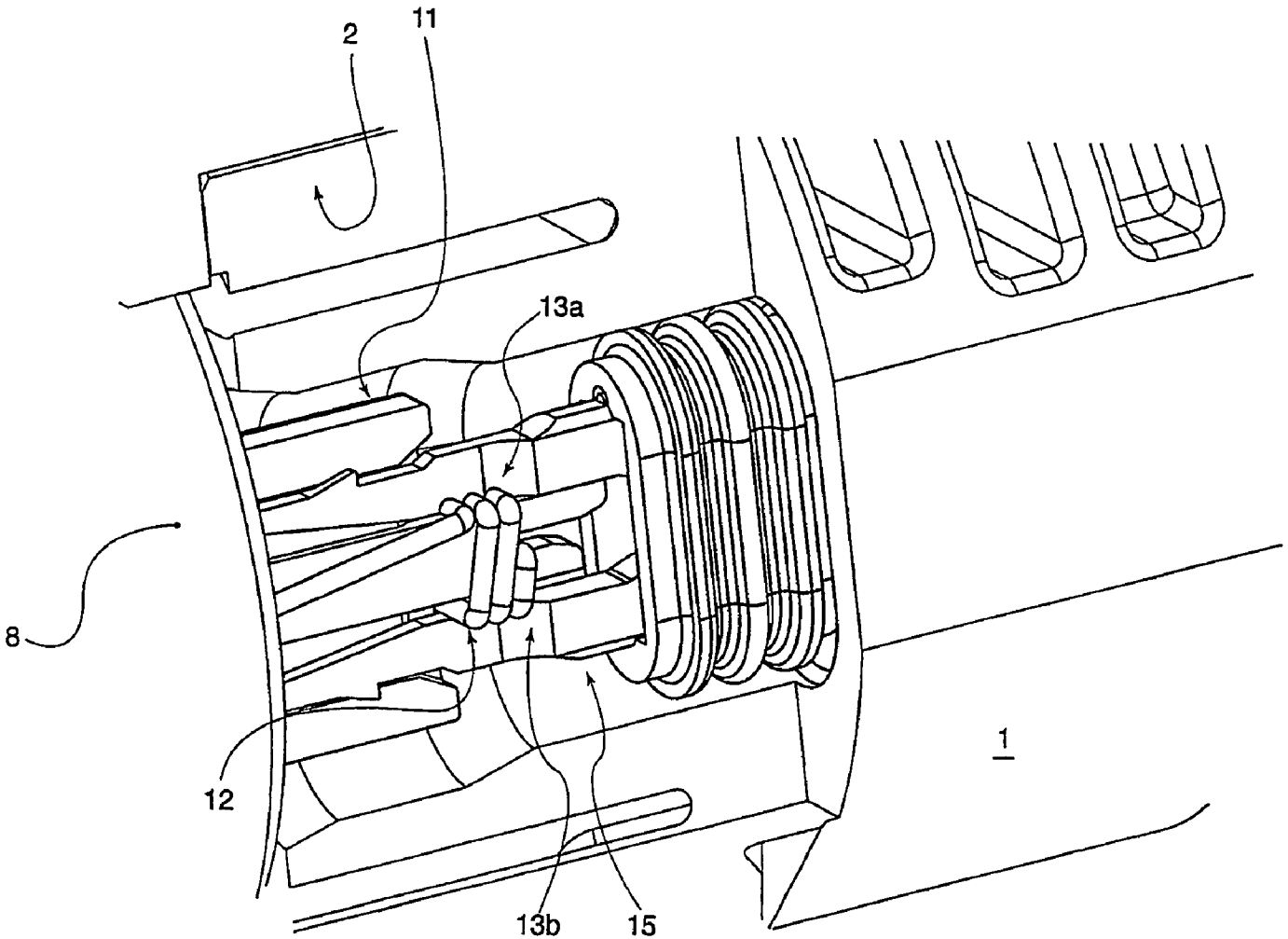
FIG. 5 depicts an enlargement of the previous perspectives, when assembly is complete.

With reference to FIG. 5, assembly is now complete and the turns of the wire (12) and the prongs (13*a*, 13*b*) are in their definitive relative positions, namely with the turns positioned practically at the base of the fork (15). In this position, as indicated hereinabove, the lateral tips of the half arrowheads are in contact with the external edgings of the slots (14), and the prongs (13*a*, 13*b*) are therefore kept perfectly in contact, under pressure, with the various turns of the wire (12).

In order to be able to guarantee that the connector (1) is correctly positioned with respect to the body (2) so that the electrical connection can be made, a polarizer (16) extending from the connector (1) is provided to fit into a corresponding cutout (17) in the pole piece (8) (see FIG. 1). This system makes it possible to ensure that the prongs (13*a*, 13*b*) of the pin (15), on the one hand, will be coaxial with the support (11) and its wire (12) on the other. It also makes it possible to prevent any rotation between the connector (1) and the field frame (7)/pole piece (8) subassembly. Finally, this configuration has the advantage of limiting the mechanical stresses on the prongs (13*a*, 13*b*)/copper wire (12) connection while the connector (1)/solenoid body (2) assembly is being screwed onto the main body of the injector (not depicted).

The invention claimed is:

1. A connection device for connecting a mechanical, hydraulic and electrical connector with which a combustion engine fuel injector is equipped, to an electromagnet that drives an injector, said connector being fixed to a body surrounding the electromagnet and comprising two electric terminals connected to a solenoid of the electromagnet, characterized in that said electric terminals are each equipped with a pin designed such that, while the connector is being assembled with the body, each pin collaborates with a guide means in contact with an end portion of the wire of the solenoid, wherein an assembly operation leads to insulation on said wire being stripped away from at least one spot of said end portion with a view to establishing an electrical connection between each terminal and the solenoid.

2. The connection device as claimed in claim 1, wherein a field frame in which the solenoid of the electromagnet is wound comprises two protrusions acting as supports for the ends of the wire and directed along the axis of assembly.

3. The connection device as claimed in claim 2, wherein each support comprises a guide for guiding the pin into contact with at least one end portion of the wire of the solenoid.

4. The connection device as claimed in claim 1, wherein the pin is in the form of a fork with two prongs of parallel appearance directed along the axis of assembly.

5. The connection device as claimed in claim 4, wherein each prong adopts the shape of half an arrowhead the cross section of which decreases toward its free end, the prongs of the fork being symmetric with respect to their median longitudinal axis.

6. The connection device as claimed in claim 4, wherein a support for an end portion of the wire of the solenoid includes a central post and near the free end of said central post the wire of the solenoid is fixed, forming several contiguous turns around it.

7. The connection device as claimed in claim 6, wherein the free end of the post is cleft.

8. The connection device as claimed in claim 6, wherein the central post is flanked by two lateral flanges in which a slot is formed to guide the prongs of the fork.

9. The connection device as claimed in claim 2, each support and each pin are directed parallel to the axis of the solenoid.

10. The connection device as claimed in claim 2, wherein the support-forming protrusion or protrusions extending from the field frame in which the solenoid is wound is/are formed as one with this field frame.

11. The connection device as claimed in claim 1, wherein the connector and the body surrounding the electromagnet are provided with a polarizing system to allow the one to be angularly positioned and immobilized with respect to the other so that each pin can be brought into register with a support and the wire which is fixed thereto during assembly.

12. The connection device as claimed in claim 11, wherein said polarizing system further comprises a projection extending beyond the connector, directed parallel to the axis of assembly and designed to collaborate with a cutout made in a pole piece of the electromagnet surrounding the solenoid.

13. A connection device for connecting a mechanical, hydraulic and electrical connector with which a combustion engine fuel injector is equipped, to a electromagnet that drives an injector, said connector being fixed to a body surrounding the electromagnet and comprising two electric terminals connected to the solenoid of the electromagnet, characterized in that said electric terminals are each equipped with a pin in a form of a fork with two prongs of parallel appearance directed along an axis of assembly, each prong having a shape of a half arrowhead, a cross section of which decreases toward a free end, said prongs of said fork being symmetric with respect to a median longitudinal axis, said pin being designed such that, while the connector is being assembled with the body, each pin collaborates with a guide means in contact with an end portion of the wire of the solenoid, wherein an assembly operation leads to insulation on said wire being stripped away from at least one spot of said end portion establishing an electrical connection between each terminal and the solenoid.

14. A connection device for connecting a mechanical, hydraulic and electrical connector with which a combustion engine fuel injector is equipped, to an electromagnet that drives an injector, said connector being fixed to a body surrounding the electromagnet and comprising two electric terminals connected to the solenoid of the electromagnet, characterized in that said electric terminals are each equipped with a pin in the form of a fork with two prongs of parallel appearance directed along an axis of assembly designed such that, while the connector is being assembled with the body, each pin collaborates with a guide means in contact with an end portion of a wire of the solenoid, said guide means including a central post and near a free of which the wire of the solenoid is fixed, forming several continuous turns around the central post, and wherein an assembly operation leads to insulation on said wire being stripped away from at least one spot of said wire end portion establishing an electrical connection between each terminal and the solenoid.

* * * * *